United States Patent [19]

Grossman et al.

[11] Patent Number: 4,746,832

[45] Date of Patent: May 24, 1988

[54] CONTROLLING THE VAPOR PRESSURE OF A MERCURY LAMP

[75] Inventors: Mark W. Grossman, Belmont; William A. George, Rockport, both of Mass.

[73] Assignee: GTE Products Corporation, Danvers, Mass.

[21] Appl. No.: 816,558

[22] Filed: Dec. 31, 1985

[51] Int. Cl.[4] ..... H01J 61/24; H01J 61/34

[52] U.S. Cl. ..... 313/22; 313/24; 313/36; 313/44; 313/634

[58] Field of Search ..... 313/22, 24, 36, 44, 313/25, 634

[56] References Cited

U.S. PATENT DOCUMENTS

| | | | |
|---|---|---|---|
| 3,360,035 | 12/1967 | Loo et al. | 313/22 X |
| 3,665,235 | 5/1972 | Hugot | 313/24 X |
| 3,673,406 | 6/1972 | Nief et al. | 250/43 |

OTHER PUBLICATIONS

*Photochemical Isotope Separation of Hg-196 by Reaction with Hydrogen Halides,* Webster, C. R. and Zare, R. N., J. Phy. Chem., 85, 1302-1305 (1981).

*Photochemical Enrichment of Hg-196,* Grossman, M., and Maya, J., XIII, Intern. Elec. Con. Tech. Dig., 139-140 (Jun. 18-21, 1984).

*Energy Conservation Through More Efficient Conservation,* Maya, J., Grossman, M. W., Lagushenko, R., Waymouth, J. F., Science 266, 435-436 (Oct. 26, '84).

*Primary Examiner*—David K. Moore
*Assistant Examiner*—K. Wieder
*Attorney, Agent, or Firm*—Hamilton, Brook, Smith & Reynolds

[57] ABSTRACT

The invention described herein discloses a method and apparatus for controlling the Hg vapor pressure within a lamp. This is done by establishing and controlling two temperature zones within the lamp. One zone is colder than the other zone. The first zone is called the cold spot. By controlling the temperature of the cold spot, the Hg vapor pressure within the lamp is controlled. Likewise, by controlling the Hg vapor pressure of the lamp, the intensity and linewidth of the radiation emitted from the lamp is controlled.

13 Claims, 2 Drawing Sheets

CONTROLLING THE VAPOR PRESSURE OF A MERCURY LAMP

GOVERNMENT RIGHTS

The Government has rights in this invention pursuant to Subcontract 4524210 under Prime Contract DE-AC03-76SF00098 awarded by the U.S. Department of Energy.

TECHNICAL FIELD

This invention is in the field of physics. It relates to controlling the vapor pressure of a mercury lamp, thus, providing for resonance radiation with a well-defined linewidth and intensity.

BACKGROUND OF THE INVENTION

The specific excitation of mercury isotopes by photochemical means is well established. See Webster, C. R. and Zare R. W., *Photochemical Isotope Separation of Hg-196 by Reaction with Hydrogen Halides,* J. Phys. Chem. 85, 1302 (1981).

Mercury vapor lamps are commonly used as the excitation source of Hg isotope specific photochemical reactions. To be successful, photochemical separation of a single isotope requires that the spectral bandwidth of the exciting mercury lamp or laser source must be sufficiently narrow to excite only the isotope of interest, the specificity depending on the spectral bandwidth of the source. The rate and extent of separation of the particular isotope from the feedstock can be strongly dependent on the intensity of the radiation emitted from the mercury lamp.

The vapor equilibrium pressure of the Hg used in the mercury lamp strongly affects the intensity and spectral linewidth of the light which is emitted from the lamp. Lamps of the prior art used for this purpose are not able to adequately control the Hg vapor pressure inside of the lamps. This is due to the fact that the lamp cold spot is not well established. The lamp cold spot is the lowest temperature region within a lamp. This cold spot temperature determines the Hg equilibrium vapor pressure within the lamp. After lamp start-up, many hours of lamp operation may be required to fix the region. During this transition time, a definite Hg pressure is not attained. This variance in the vapor pressure of the mercury within the lamp can cause disturbances in the linewidth and intensity of resonance radiation emitted, thus, undersirable isotopes of Hg can be stimulated and the rate of separation of the desired isotope of mercury can be affected. Further, without knowing the location of the cold spot, it may not be possible to monitor the Hg vapor pressure.

SUMMARY OF THE INVENTION

This invention comprises a process for controlling the vapor equilibrium pressure in a mercury lamp. This is done by establishing and controlling two temperature zones within the lamp. The first of the two temperature zones is a cold spot and the second zone is at a temperature greater than the first zone. In this manner, the temperature and the equilibrium vapor pressure of the Hg within the entire lamp can be controlled. As a consequence of this, the bandwidth and intensity of the radiation emitted by the lamp is controlled.

This invention also comprises a novel mercury-inert gas microwave lamp which contains a means for creating a controlling a cold spot. The lamp comprises an inner quartz discharge tube and an outer tube. In one embodiment, the outer jacket is made of quartz. The inner tube may be made with various diameter. A novel aspect of this lamp is the demountable outer jacket. The outer jacket serves several purposes. First, it allows for two separate temperature zones. This permits the use of a gas purge for eliminating $O_2$ about the transmission section which reduces $O_3$ formation. By using gas instead of water, microwave power losses are substantially reduced. Second, it permits the interchange of different inner discharge tubes. This makes possible the use of different Hg isotopic distributions in the same outer jacket by simply exchanging inner discharge tubes. Also, different diameter inner discharge tubes may be used to affect the Hg linewidth.

Third, the fact that the outer tube is demountable allows for the use of outer tubes made of different types of materials. For example, by changing the outer tube material to Vycor 7910, it is possible to filter the 185 nm radiation.

Flow diffusers, sections of "O" rings or gaskets, allow for uniform distribution of cooling medium within the discharge tube and maintains spacing of the inner tube and outer discharge tube.

An "O" ring creates two separate zones for cooling, one cooled by water and one cooled by gas. The temperature of the zone cooled by gas can be further regulated by a heater coil. This ensures that the cold spot temperature is always at the water cooled end of the excitation source.

DETAILED DESCRIPTION OF THE INVENTION

In accordance with this invention, a process for creating and controlling a cold spot or mercury liquid vapor equilibrium temperature within a mercury-noble gas lamp is provided. A cold spot is the lowest temperature within the lamp. It is necessary to control the cold spot temperature because this temperature determines the vapor equilibrium within the lamp, which greatly influences the intensity and linewidth of the radiation wavelength emitted from the lamp. By creating and isolating a cold spot within a lamp, a known and fixed vapor equilibrium pressure is established throughout the lamp. This eliminates long term transient lamp output and results in a more reproducible lamp output intensity and linewidth.

In one embodiment, a cold spot temperature is created in a lamp by circulating $H_2O$ about an isolated section of the lamp. An inert gas, preferably nitrogen, is circulated about the remainder of the lamp in order to control the temperature of that portion of the lamp. The use of a heater coil permits separate temperature control of the inert gas. This ensures that the cold spot temperature is always at the water cooled end of the excitation source.

This process produces a lamp with two temperature zones. The inert gas which is circulated about the remainder of the lamp must be at a higher temperature than that of the cold spot. The creation of the cold spot establishes a fixed mercury vapor pressure within the lamp. The inert gas which is circulated about the remainder of the lamp also prevents the formation of $O_3$ by purging any $O_2$ in the vicinity of the lamp. Ozone is created when $O_2$ is exposed to the 185 nm radiation emitted by the lamp. Ozone, in turn, absorbs the 253.7 nm radiation emitted from the lamp and used to selectively excite different isotopes of mercury. Thus, by circulating an inert gas about the entire exterior of the lamp, all of the $O_2$ is purged from the immediate vicinity of the lamp which allows for a greater intensity of 253.7 nm radiation. The use of water as a purge substance results in a strong loss of microwave energy being coupled and away from the lamp into the water. This greatly reduces the lamp output.

Figure 1:
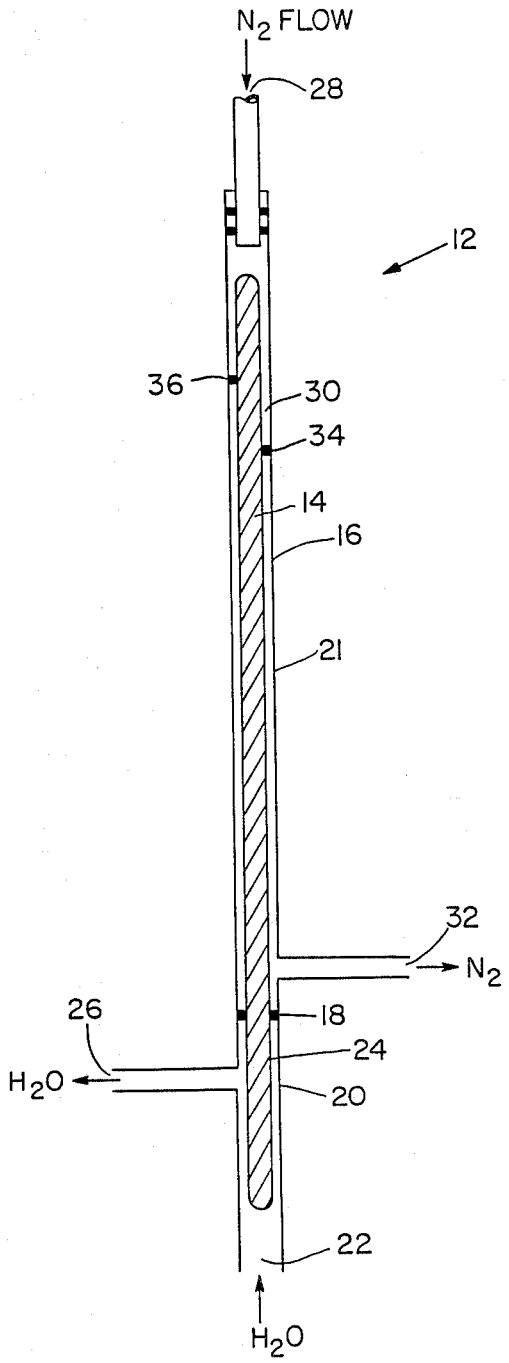
FIG. 1 illustrates a mercury lamp, the cold spot of which is controlled using the process and apparatus of the present invention.

FIG. 1 illustrates a lamp which incorporates the elements of this invention.

The mercury lamp 12 of FIG. 1 is comprised of an inner quartz discharge tube 14 and an outer tube 16. The inner tube 14 may be made of various diameters. For the isotope separation of $Hg^{196}$ the inner diameter of the tube is 5 mm. The inner tube 14 typically contains argon (2.5 Torr) and Hg However, any comparable inert gas may be used. A minimum of 1–2 mg of Hg is contained within an inner discharge tube with an inner diameter of 5 mm.

"O" ring 18 divides and partitions the exterior portion of the inner discharge tube 14 and the inner portion of the exterior tube into two segments 20 and 21. The cold spot segment 20 is cooled by $H_2O$. $H_2O$ is introduced into the interior of the external tube 16 through inlet 22. The $H_2O$ circulates about the portion of the inner discharge tube 24 which is contained within cold spot 20. The $H_2O$ then exits the cold spot 20 through outlet 26 contained in the outer tube 16.

An inert gas is circulated about segment 21 of the mercury lamp 12. In a preferred embodiment, the inert gas used is nitrogen. The gas is introduced into the interior of the outer tube through inlet 28; it circulates about section 30 of the inner discharge 14. The nitrogen then exists through outlet 32. Partial "O" rings 34 and 36 promote the even circulation of the nitrogen. In this manner, the temperature of segment 21 of the mercury lamp 12 is controlled. By controlling the temperature of the mercury lamp the equilibrium vapor pressure of the lamps is then controlled. This allows for greater control of the intensity and selectivity of the linewidth of the radiation that is to be emitted from the lamp.

Experimentally, the cold spot temperature is controlled by the temperature of the circulating water (as long as rest of lamp is at higher temperature). As the circulating water temperature increases or decreases so does the cold spot temperature. The linewidths of the 253.7 nm components are strongly affected by cold spot temperatures between 10° C. and 15° C. and higher temperatures for a 5 mm internal diameter (ID) lamp. The emission intensity depends strongly on the cold spot temperature for any lamp I.D.

Measuring the linewidth and the line intensity via a suitable detector (e.g. Fabry-Perot interferometer) permits a calibration of linewidth and intensity versus the temperature of the water bath being circulated about a portion of the lamp creating the cold spot of the lamp. Furthermore, the lamp wall temperature can be directly measured to relate linewidth and line intensity to wall temperature.

A difference, which is often neglected, exists between the lamp cold spot temperature and the lamp wall temperature. The difference is usually determined by calculation based on energy balance and heat transfer concepts. Thus, for a 40 watt lamp, 4 feet long, and 1.5 inches in diameter, the cold spot is about 2° C. higher in temperature than the wall temperature when normal operation takes place. This difference is particularly important for theoretical modeling, but not critical for application of the present invention.

Figure 2:
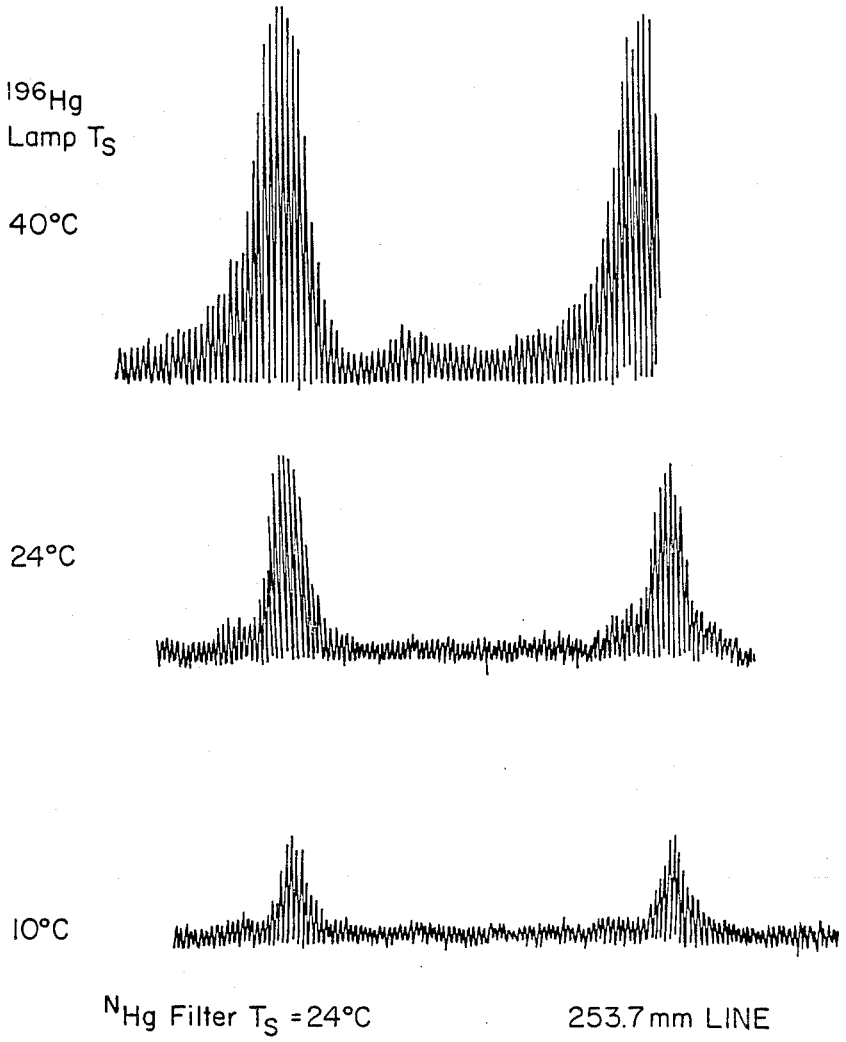
FIG. 2 illustrates graphs of the variation in intensity as a function of lamp cold spot temperature.

FIG. 2 illustrates the relationship between the cold spot temperature, the intensity of the radiation emitted and the linewidth of the 253.7 nm line. The colder that the temperature of the cold spot is, the lower the vapor equilibrium pressure becomes. The vapor pressure of the Hg within the lamp and the intensity of the radiation are proportional within 10–15%. However, as the intensity of the radiation emitted from the lamp increases, the linewidth of the radiation emitted also increases; this can cause undesired isotopes of Hg to be excited. Therefore, it is very important to control the vapor pressure of the lamp to ensure that radiation with the proper linewidth is emitted. The vapor pressure is controlled by controlling the cold spot temperature of the lamp as described above. For a further explanation of the relationship between lamp temperature, radiation intensity and linewidth of the radiation see Maya J., Grossman M. W., Layushenko R., and Waymouth I. F., *Energy Conservation Through More Efficient Lighting,* Science 26 435–436 (Oct. 26, 1984) and Webster C. R. and Zare R. N. *Photochemical Isotope Separation of Hg-196 by Reaction with Hydrogen Halides,* J. Phys. Chem 85, 1302–1305 (1981) the teachings of which are hereby incorporated by reference.

By using a mercury lamp of the present invention in a photochemical separation apparatus such as the one shown in Zare and Webster, id at page 1302, greater and purer yields of Hg-196 can be obtained. Because the vapor equilibrium pressure of the mercury in the lamp is controlled, only Hg-196 is excited and is available for a chemical reaction with a halide. If the vapor pressure exceeds a certain point, the 253.7 nm line broadens sufficiently so that other mercury isotopes are excited.

Successful photochemical separation of a single isotope requires that two fundamental conditions be fulfilled: (i) The spectral bandwith of the exciting mercury lamp or laser source must be sufficiently narrow to excite only the isotope of interest, the specificity depensing on both the spectral bandwidth and the profile of the 253.7-nm line. (ii) A substrate must be found that reacts with excited mercury atoms to form a stable, separable compound but has no reaction with unexcited atoms. Furthermore, both the substrate and reaction product must be photochemically stable in the presence of 253.7-nm radiation. Condition (i) is satisfied in the experiments reported here by using a "monoisotopic" mercury lamp and filter combination. Cooling of the lamp below 35° C. is necessary to avoid problems of self-reversal which otherwise serve to broaden the spectral bandwidth and thereby reduce the isotope specificity. The profile of the 253.7-nm line referred to in condition (i) includes not only the extent to which any isotopic lines are overlapped within their Doppler widths but also any homogeneous or inhomogeneous broadening resulting from the atomic mercury density and substrate pressure used.

Isotope depletion is an unwanted effect. In a static system, as all of the Hg-196 available is converted into product, the wings of the lamp emission profile take on an increasing importance by eventually separating out the other isotopes, the result producing a less enriched or an unenriched compound. Similarly, in a flow system a precipitate highly enriched in Hg-196 may build up at the reactant entrance to the excitation region, while a precipitate depleted in Hg-196 may build up near the exit; collecting both deposits and mixing them then produces a sample of less apparent enrichment. The use of intermittent illumination by means of a rotating sector constructed to reduce the time of exposure to radiation of a given mercury sample can be used to solve this problem.

Accordingly, natural mercury is exposed to 253.7-nm radiation in the reaction chamber, a hydrogen halide (HCl, HBr or HI) or other suitable reactant containing 1,3-butadiene is to mixed with the mercury reacting with the excited Hg-196. A mercurous compound is produced containing primarily only Hg-196.

INDUSTRIAL APPLICABILITY

The invention described herein relates to a process and apparatus for controlling the equilibrium vapor pressure of Hg within a mercury lamp. Thus, it is useful in controlling the intensity and linewidth of the radiation emitted from a mercury lamp. This, in turn, is useful in selectively exciting isotopes of mercury for the isolation of a particular isotope of mercury.

EQUIVALENTS

Those skilled in the art will recognize or be able to ascertain, using no more than routine experimentation, many equivalents to the specific embodiments described herein. Such equivalents are to be covered by the following claims.

We claim:

1. A method for controlling the vapor equilibrium pressure of mercury in a mercury lamp, which comprises:

establishing and controlling two discrete temperature zones within the lamp, said first zone being a cold spot and said second zone being at a temperature greater than the first zone, thereby producing a controlled vapor equilibrium pressure throughout the lamp allowing control of the selectivity and intensity of the linewidth of the radiation emitted from the lamp.

2. A method as recited in claim 1, wherein the two temperature zones of said mercury lamp are established and controlled by:

(a) isolating the exterior of said lamp into two sections, and (b) circulating different temperature controlling means about the two section so as to obtain the temperature desired in each section.

3. A method as recited in claim 2, wherein the temperature controlling means in the first temperature zone is $H_2O$.

4. A method as recited in claim 2, wherein the temperature controlling means in the second temperature zone is an inert gas.

5. A method for controlling the vapor equilibrium pressure of mercury in a mercury lamp, which comprises:

(a) isolating the exterior of said lamp into two sections; and (b) circulating different temperature controlling means about the two sections, water being the temperature controlling means circulated about a first section of the mercury lamp, thus creating a cold spot, and nitrogen being the temperature controlling means circulated about a second section of the mercury lamp, so as to obtain the temperature desired in each section, in this manner, controlling the vapor equilibrium pressure of the mercury in the mercury lamp, thereby allowing control of the selectivity and intensity of the linewidth of the radiation emitted from the lamp.

6. A mercury lamp, which comprises:

(a) an inner discharge tube, said discharge tube containing mercury and an inert gas;

(b) an outer tube which envelopes the inner discharge tube;

(c) dividing means, said dividing means being located within the outer tube and surrounding the inner discharge tube; the dividing means thus dividing the outer tube into two sections, each section of said outer tube containing an inlet and an outlet for the circulation of separate temperature controlling means within the outer discharge tube, thus providing means by which the temperature of the inner discharge tube is controlled, thus providing a means by which the vapor equilibrium pressure within the inner discharge tube is controlled, thereby allowing control of the selectivity and intensity of the linewidth of the radiation emitted from the lamp.

7. A mercury lamp as recited in claim 6, wherein the inner discharge tube is composed of quartz.

8. A mercury lamp as recited in claim 6, wherein the outer tube is composed of quartz.

9. A mercury lamp as recited in claim 6, wherein the dividing means is an "O" ring.

10. A mercury lamp as recited in claim 6, wherein the temperature controlling means in one section of the outer tube is $H_2O$, thus establishing a cold spot within the inner discharge tube.

11. A mercury lamp as recited in claim 6, wherein the temperature controlling means in the second section of the outer tube is an inert gas.

12. A mercury lamp as recited in claim 6, wherein the inert gas is selected from the group consisting of nitrogen, helium, neon, and argon.

13. A mercury lamp, which comprises:

(a) an inner quartz discharge tube, said discharge tube containing mercury and argon;

(b) an outer quartz tube, said outer tube enveloping the inner discharge tube;

(c) an "O" ring, said "O" ring being located within the outer tube and surrounding the inner discharge tube;

the "O" ring thus divides the outer tube into two sections, each section of said outer tube containing an inlet and an outlet for the circulation of separate temperature controlling means, water being the temperature controlling means in the first section, thus producing a cold spot within the section of the inner discharge tube which is surrounded by the first section of the outer tube, nitrogen being the temperature controlling means in the second section of the outer tube, thus, providing means by which the temperature of the inner discharge tube is controlled, thus controlling the vapor equilibrium pressure within the inner discharge tube, thereby allowing control of the selectivity and intensity of the linewidth of the radiation emitted from the lamp.

* * * * *